US006414654B1

(12) United States Patent
Makino

(10) Patent No.: US 6,414,654 B1
(45) **Date of Patent: *Jul. 2, 2002**

(54) PLASMA DISPLAY PANEL HAVING HIGH LUMINANCE AT LOW POWER CONSUMPTION

(75) Inventor: Mitsuyoshi Makino, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/106,006

(22) Filed: Jun. 29, 1998

(30) Foreign Application Priority Data

Jul. 8, 1997 (JP) ..... 9-182224

(51) Int. Cl.[7] ..... G09G 3/28
(52) U.S. Cl. ..... 345/60; 345/204
(58) Field of Search ..... 345/60, 63, 68, 345/148, 204–213; 315/169.4, 169.1, 169.2

(56) References Cited

U.S. PATENT DOCUMENTS 3,944,875 A * 3/1976 Owaki et al. ..... 315/169 TV
4,611,203 A * 9/1986 Criscimagna et al. ..... 340/773
4,772,884 A * 9/1988 Weber et al. ..... 340/776
5,142,200 A * 8/1992 Yamamoto et al. ..... 315/169.4
5,315,213 A * 5/1994 Kim ..... 315/169.1
5,446,344 A * 8/1995 Kanazawa ..... 315/169.4
5,684,499 A * 11/1997 Shimizu et al. ..... 345/60
5,745,086 A * 4/1998 Weber ..... 345/63
5,818,419 A * 10/1998 Tajima et al. ..... 345/147
5,835,072 A * 11/1998 Kanazawa ..... 345/60
5,841,413 A * 11/1998 Zhu et al. ..... 345/63
5,874,932 A * 2/1999 Nagaoka et al. ..... 345/60
5,952,986 A * 9/1999 Nguyen et al. ..... 345/68
5,959,619 A * 9/1999 Kameyama et al. ..... 345/204
6,020,687 A * 1/2000 Hirakawa et al. ..... 315/169.1
6,052,112 A * 4/2000 Tanaka et al. ..... 345/147
6,133,903 A * 10/2000 Lee et al. ..... 345/148

FOREIGN PATENT DOCUMENTS

| | | |
|---|---|---|
| JP | 2-219092 | 8/1990 |
| JP | 4-229896 | 8/1992 |
| JP | 9-198006 | 7/1997 |
| JP | 10-26954 | 1/1998 |
| JP | 10-149136 | 6/1998 |

* cited by examiner

*Primary Examiner*—Vijay Shankar
*Assistant Examiner*—Vanel Frenel
(74) *Attorney, Agent, or Firm*—McGinn & Gibb, PLLC

(57) ABSTRACT

A method of driving a plasma display panel is disclosed. The sustain discharge frequency of sustain electrodes and scan electrodes is set to a high level during the first half of a sustain discharge period during which there are few discharges and the effect of saturation need not be considered. On the other hand, the sustain discharge frequency of sustain electrodes and scan electrodes is set to a lower level in order to limit the effect of saturation during the latter half of a sustain discharge period in which the number of discharges is great and saturation cannot be ignored.

20 Claims, 6 Drawing Sheets

PLASMA DISPLAY PANEL HAVING HIGH LUMINANCE AT LOW POWER CONSUMPTION

BACKGROUND OF THE INVENTION

1. Field of the Invention

The present invention relates to a method of driving a plasma display panel having a plurality of scan electrodes aligned in a row direction, a plurality of data electrodes aligned in a column direction, and a plurality of sustain electrodes that are formed parallel with the scan electrodes and that are each paired with a scan electrode.

2. Description of the Related Art

As flat display panels that can be readily applied to large-screen applications, plasma display panels (hereinbelow abbreviated "PDP") that can be used for such purposes as a display output of personal computers, display output of work stations, and wall-hung televisions can be divided between two types depending on the operating method. One type is the direct-current discharge PDP in which electrodes are exposed to discharge gas and discharge is brought about only during the application of voltage, and the other is alternating-current PDP in which electrodes are covered with a dielectric and discharge is brought about without exposing the electrodes to discharge gas. The alternating-current PDP (hereinbelow referred to as "AC-PDP") has a memory capability in the discharge cells themselves due to the charge-storing effect of a dielectric.

FIG. 1 is a section view showing the configuration of a typical AC-PDP of the prior art. In the AC-PDP shown in FIG. 1, the construction described hereinbelow is formed in a space enclosed between front substrate 10 containing glass and rear substrate 11 similarly containing glass.

Scan electrodes 12 and sustain electrodes 13 are alternately formed at a prescribed spacing on front substrate 10. Scan electrodes 12 and sustain electrodes 13 are covered with insulation layer 15*a*, and protective layer 16 that protects insulation layer 15*a* from discharge and contains, for example, MgO, is formed on insulation layer 15*a*. In addition, data electrodes 19 are formed on rear substrate 11 orthogonal to scan electrodes 12 and sustain electrodes 13 on front substrate 10. Data electrodes 19 are covered with insulation layer 15*b*, and phosphor 18 is applied on insulation layer 15*b* to effect display by converting ultraviolet rays generated by discharge into visible light. In addition, barrier ribs 17 that both establish discharge spaces 20 and demarcate pixels are formed between insulation layer 15*a* on front substrate 10 and insulation layer 15*b* on rear substrate 11. A gas mixture of, for example, helium, neon and xenon is charged within discharge spaces 20 as the discharge gas.

FIG. 2 is a plan view showing the arrangement of electrodes in the AC-PDP shown in FIG. 1. In the electrode configuration of the AC-PDP shown in FIG. 2, m scan electrodes $\mathbf{12}_i$ (i=1, 2, . . . , m) are formed in the row direction, n data electrodes $\mathbf{19}_j$ (j=1, 2, . . . , n) are formed in the column direction, one pixel being formed at each point of intersection. Sustain electrodes $\mathbf{13}_i$ are formed in the horizontal direction to form pairs with scan electrodes $\mathbf{12}_i$, scan electrodes $\mathbf{12}_i$ and sustain electrodes $\mathbf{13}_i$ being mutually parallel. A color display AC-PDP is produced by separately applying phosphor 18 shown in FIG. 1 to each pixel in the three colors Red, Green, and Blue.

FIG. 3 is a timing chart showing the waveforms of the drive voltage applied to each electrode of the AC-PDP shown in FIG. 2. Explanation is next presented regarding the drive method of an AC-PDP of the prior art with reference to FIG. 3.

Extinguishing pulse 21 is first applied to all scan electrodes 12 to extinguish pixels that were emitting light before the time shown in FIG. 3, whereby all pixels are extinguished. Next, preparatory discharge is effected by applying preparatory discharge pulse 22 to sustain electrodes 13 to force all pixels to discharge and emit light. Preparatory discharge extinguishing pulse 23 is then applied to scan electrodes 12 to extinguish the preparatory discharge of all pixels. This preparatory discharge facilitates subsequent write discharge.

After extinguishing the preparatory discharge, scan pulses 24 are applied to each of scan electrodes $\mathbf{12}_1$–$\mathbf{12}_m$ at a staggered timing, and, synchronized to the timing of the applied scan pulses 24, data pulses 27 that correspond to display data are applied to data electrodes $\mathbf{19}_1$–$\mathbf{19}_n$. The diagonal lines of data pulses 27 in FIG. 3 indicate that the presence or absence of data pulses 27 is determined according to the presence or absence of display data. Write discharge occurs within discharge spaces 20 between scan electrodes 12 and data electrodes 19 shown in FIG. 1 in pixels in which data pulse 27 is applied at the time of scan pulse 24 is applied, and write discharge does not occur if data pulse 27 is not applied at the time scan pulse 24 is applied.

In a pixel in which write discharge occurs, a positive charge referred to as a wall charge is stored in insulation layer 15*a* at scan electrode 12. At this time, a negative wall charge is stored on insulation layer 15*b* on data electrode 19. First sustain discharge occurs due to the combination of the positive potential due to the positive wall charge formed on insulation layer 15*a* on scan electrodes 12 and first sustain discharge pulse 25 of negative polarity that is applied to sustain electrodes 13. When first sustain discharge occurs, a positive wall charge is stored in insulation layer 15*a* at sustain electrode 13 and a negative wall charge is stored in insulation layer 15*a* over scan electrode 12, thereby forming a potential difference. The potential difference due to these wall charges combines with second sustain discharge pulse 26 applied to scan electrodes 12, generating a second sustain discharge. Sustain discharge thus continues with the potential difference caused by wall charge formed by the $x^{th}$ sustain discharge combining with the $(x+1)^{th}$ sustain discharge pulse. The amount of emitted light is controlled by the number of times sustain discharge is continued.

If the voltages of sustain discharge pulse 25 and sustain discharge pulse 26 are adjusted in advance to a level such that discharge is not generated by these pulse voltages alone, first sustain discharge will not occur despite the application of first sustain discharge pulse 25 in pixels in which write discharge has not occurred because there is no potential due to wall charge before first sustain discharge pulse 25 is applied, and subsequent sustain discharges will also not occur.

Sustain discharge pulse 25 and sustain discharge pulse 26 are usually applied to sustain electrodes 13 and scan electrodes 12 at a frequency on the order of 100 kHz. In addition, sustain discharge pulse 25 and sustain discharge pulse 26 have phases shifted 180° to each other. The frequency of generation of sustain discharges is on the order of 200 kHz because sustain discharge pulses 25 are alternately applied to sustain electrodes 13 and scan electrodes 12.

Explanation is next presented regarding the gray-scale display method of an AC-PDP. In an AC-PDP, the drive sequence explained in FIG. 3 is referred to as a sub-field. Essentially, the display ON/OFF is determined by write discharge in a sub-field, and the luminance of the emitted light is determined by the number of times of sustain discharge.

FIG. 4 is a chart showing the rate of the number of sustain discharge pulses during one image display period. Gray-scale display by sub-field divisions is explained with reference to FIG. 4. Referring to FIG. 4, in an usual AC-PDP, one image display period is divided into a plurality of subfields, and ON/OFF control of display is effected in each sub-field. If the number of sustain discharges varies in each sub-field and, for example, the ratio of the number of sustain discharges is made 1:2:4:8 in a four sub-field division, 16 tones can be displayed by means of the ON/OFF control of each sub-field. In other words, tones in 16 gradations can be displayed from a gray-scale level of 0 when the display of all sub-fields is OFF up to a gray-scale level of 15 when the display of all sub-fields is ON.

In a color PDP of the prior art, the number of sustain discharges must be increased to increase the luminance of emitted light. Accordingly, either of two measures are adopted to increase the luminance of emitted light, one being a method in which the drive frequency is raised without changing the sustain discharge period, and the other method being a method in which the sustain discharge period is lengthened while increasing the number of sustain discharge pulses. In either of the measures, however, there are the problems that the.luminous efficiency decreases with the occurrence of both saturation of ultraviolet light emission caused by sustain discharge and the saturation of the fluorescent emission that is excited by the ultraviolet light, and increase in the luminance of emitted light incurs a disproportionately greater increase in power consumption.

SUMMARY OF THE INVENTION

It is an object of the present invention to provide a PDP drive method that enables high luminance of emitted light at low power consumption and without a decrease in luminous efficiency when carrying out sustain discharge.

To achieve the above-described object, the present invention divides a sustain discharge period of at least one sub-field from a plurality of sub-fields into a plurality of sub-sustain discharge periods; sets a first sustain discharge frequency as the sustain discharge frequency of an initial first sub-sustain discharge period of these sub-sustain discharge periods; and sets a second sustain discharge frequency that is lower than the first sustain discharge frequency as the sustain discharge frequency of the second final sub-sustain discharge period of the sub-sustain discharge periods.

Alternatively, the sustain discharge period of at least one sub-field of the plurality of sub-fields is divided into a plurality of sub-sustain discharge periods; and first sub-sustain discharge periods in which sustain discharge is effected and second sub-sustain discharge periods in which sustain discharge is not effected are arranged alternately.

As yet another alternative, a third drive frequency of a third sustain discharge pulse, which is at least one of the first drive frequency of the first sustain discharge pulse applied to the scan electrodes and the second drive frequency of the second sustain discharge pulse applied to the sustain electrodes, is varied within the sustain discharge period.

In other words, the present invention sets the sustain discharge frequency of at least one of the sustain electrodes and scan electrodes to a high frequency during the first half of a sustain discharge period in which the number of discharges is low and the effect of light saturation is insignificant, and, in order to lessen the effect of light saturation, sets the sustain discharge frequency of at least one of the sustain electrodes and scan electrodes to a low frequency during the second half of a sustain discharge period in which the number of discharges has become high and the effect of light saturation must be taken into consideration. In addition, a blank period of at least one sustain discharge pulse of the sustain electrodes and scan electrodes is provided during a sustain discharge period before the number of sustain discharges becomes great and the light saturation is reached, following which sustain discharge is again carried out. As a result, the light saturation phenomenon can be suppressed even though the number of sustain discharges becomes great, and high luminance can be obtained with low power consumption and without a drop in luminous efficiency.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 1:
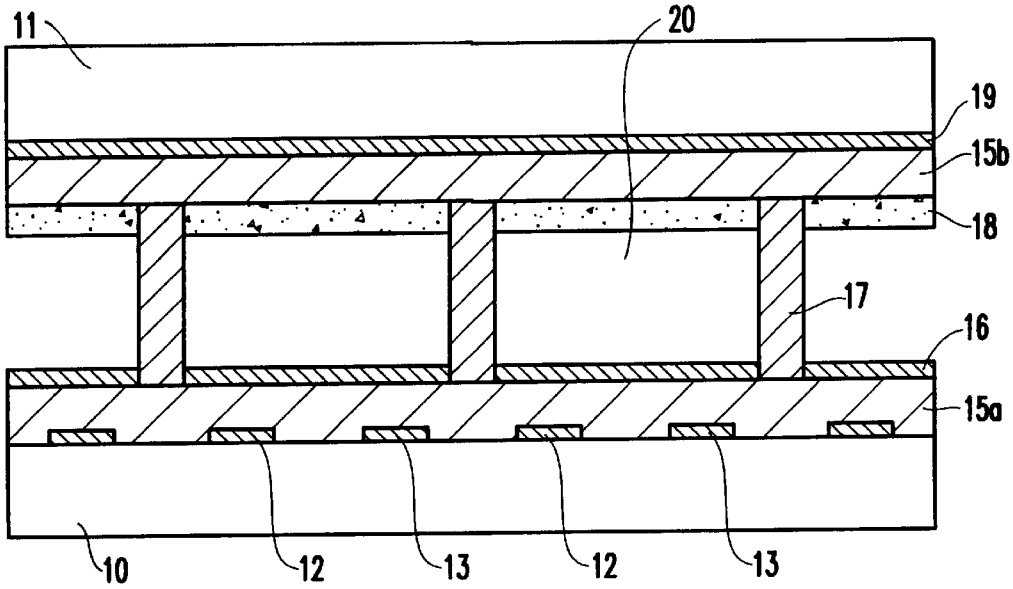
FIG.1 PRIOR ART
FIG. 1 is a sectional view showing the construction of a typical AC-PDP of the prior art.
Figure 2:
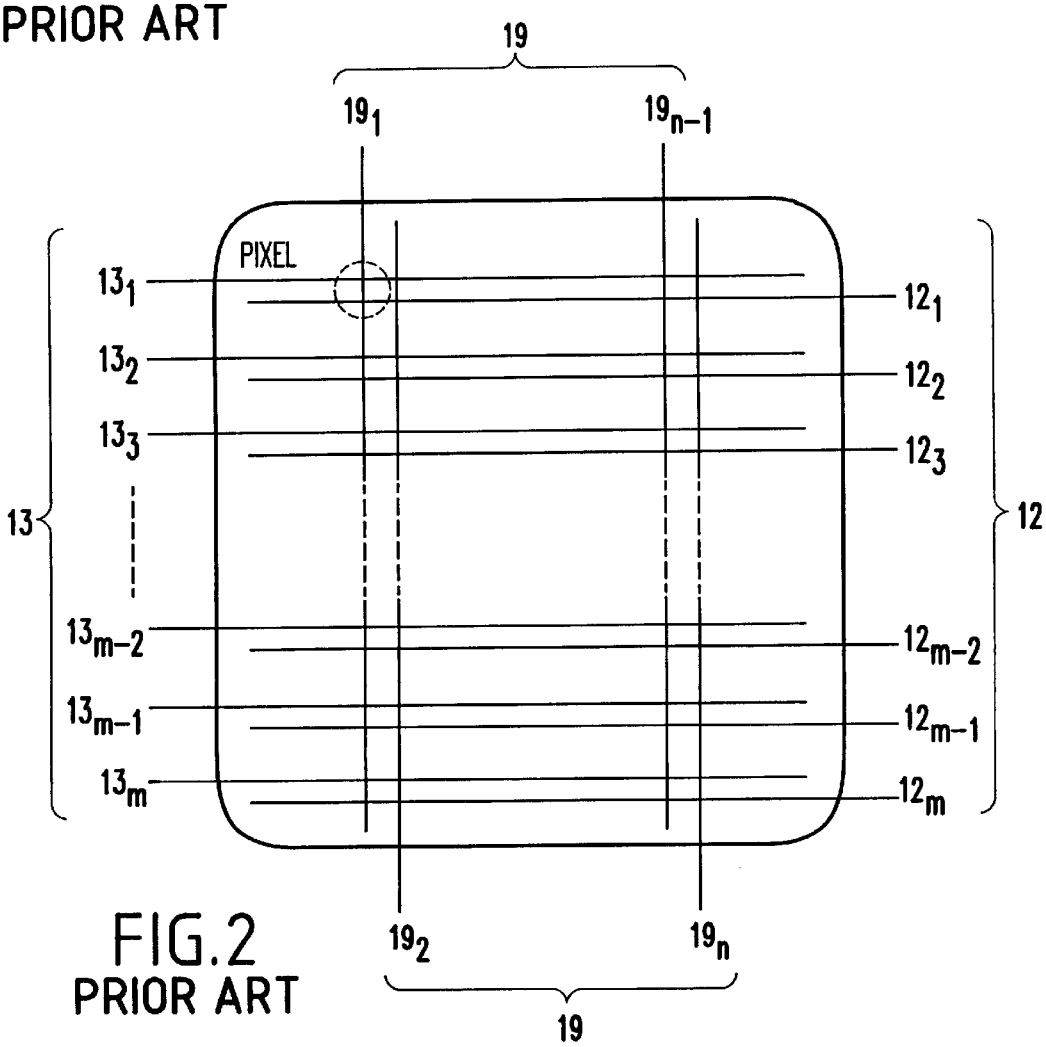
FIG.2 PRIOR ART
FIG. 2 shows the arrangement of electrodes in the AC-PDP shown in FIG. 1.
Figure 3:
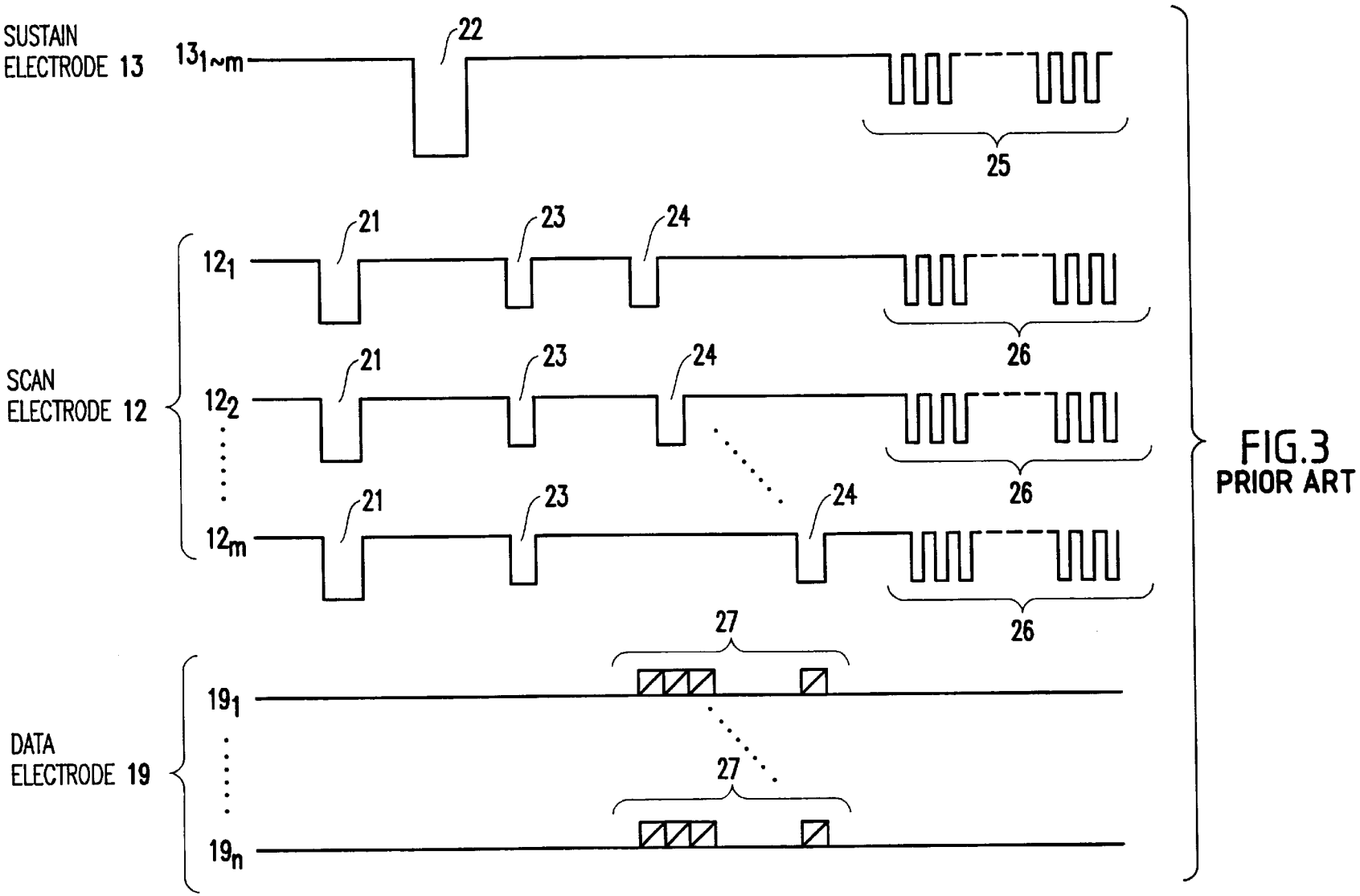
FIG.3 PRIOR ART
FIG. 3 shows the waveform of the drive voltage impressed to each electrode of the AC-PDP shown in FIG. 2.
Figure 4:
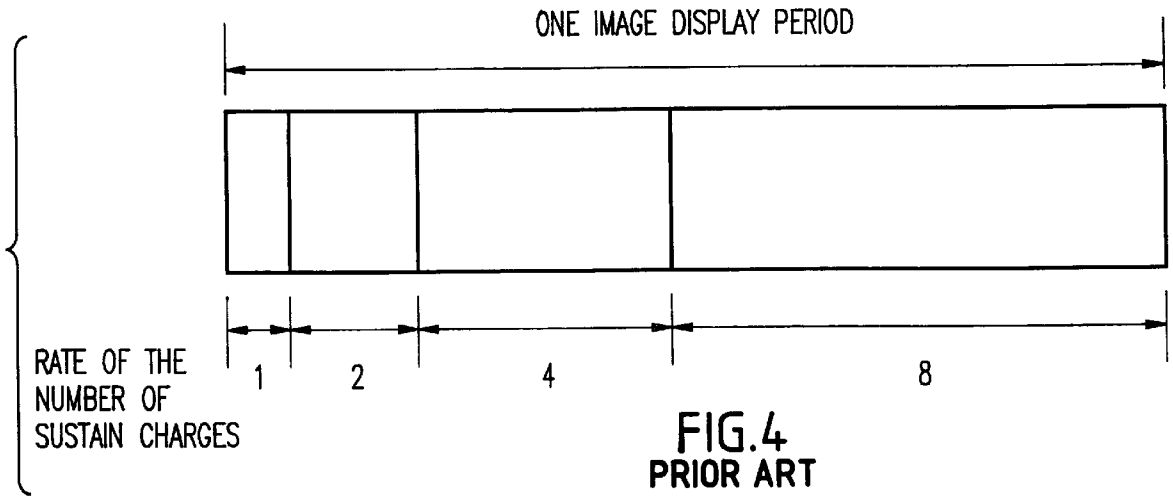
FIG.4 PRIOR ART
FIG. 4 shows the ratio of sustain discharge pulses in one image display period.
Figure 5:
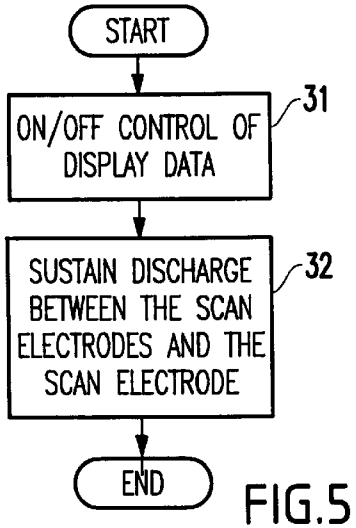
FIG. 5 is a flow chart showing the embodiments of the present invention.

As shown in FIG. 5, in the method of driving a plasma display panel according to the present invention includes Step 31 and Step 32. In Step 31, ON/OFF control of display data is carried out by scan pluses applied to scan electrodes and data pulse applied to data electrodes in each of a plurality of sub-fields into which a unit image display period is divided. In Step 32, sustain discharge is effected between scan electrodes and sustain electrodes parallel to said scan electrodes in only those cells in which the display data are ON following ONIOFF control of display data.

(First Embodiment)

Figure 6:
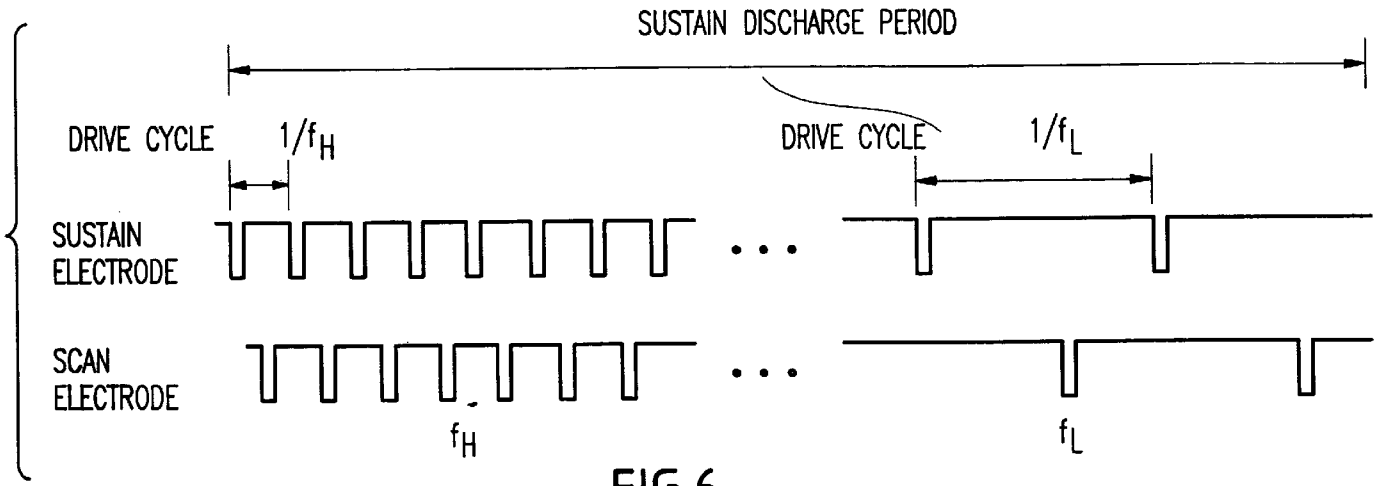
FIG. 6 shows the form of pulses applied during a sustain discharge period in the first embodiment of the present invention.

As shown in FIG. 6, in the first embodiment of the present invention in Step 32, sustain discharge pulses are applied at high frequency fH to sustain electrodes and scan electrodes at the beginning of the sustain discharge period, and sustain discharge pulses are applied at a low frequency $f_L$ ($f_L<f_H$) at the end of the sustain discharge period. In this case, the frequency of generation of sustain discharge is the number of sustain discharge pulses applied to PDP cells per unit time, this frequency being $2f_H$ at the beginning of the sustain discharge period and $2f_L$ at the end of the sustain discharge period.

Figure 7:
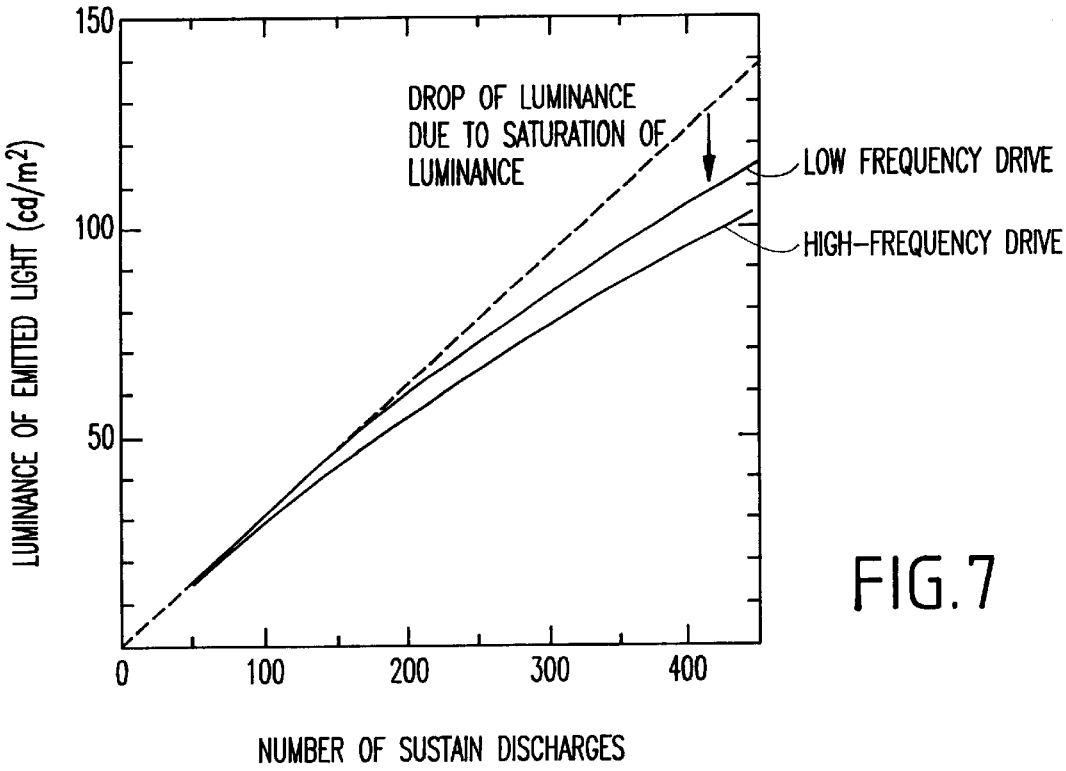
FIG. 7 is a graph showing the relation between the number of sustain discharges and the luminance of emitted light.

Explanation is next presented using FIG. 7 regarding the phenomenon of light saturation caused by increase in the number of sustain discharges.

As shown in FIG. 7, the luminance of emitted light is gradually saturated as the number of sustain discharges increases, the rate of increase in luminance being outstripped by the rate of increase in the number of discharges. In addition, the rate of saturation of luminance of emitted light increases with higher frequencies of sustain discharge. While the type of phosphor and the intensity of discharge are also factors, light saturation converges after several hundred to several ten thousand sustain discharges and the luminance per sustain discharge enters a fixed stationary state.

Figure 8:
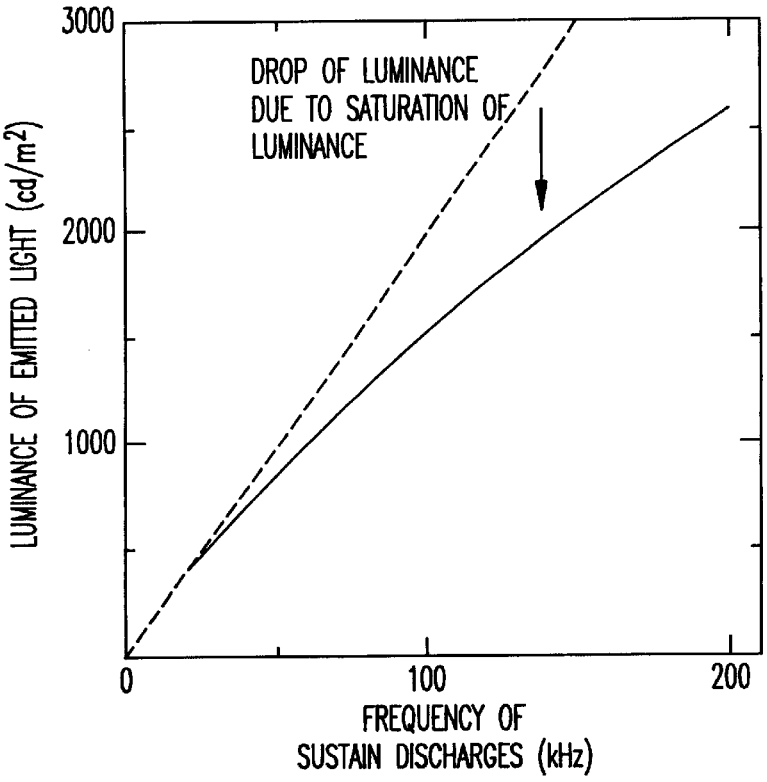
FIG. 8 is a graph showing the relation between the frequency of sustain discharges and the luminance of emitted light when the sustain discharges are repeated continuously.

FIG. 8 is a characteristics chart showing the relation between sustain discharge frequency and the luminance of emitted light when sustain discharge is repeated continuously. FIG. 8 also shows luminance in the stationary state in which light saturation has converged in accordance with the number of sustain discharges shown in FIG. 7. The light saturation phenomenon brought about by increase in the sustain discharge frequency is explained with reference to FIG. 8.

As shown in FIG. 8, luminance of emitted light in the stationary state is saturated when the sustain discharge frequency is increased, and the rate of increase in luminance of emitted light is less than the rate of increase in sustain discharge frequency.

To summarize the phenomenon of light saturation in sustain discharge based on FIG. 7 and FIG. 8, the luminance of emitted light can be seen as substantially proportional to the number of sustain discharges regardless of the level of sustain discharge frequency as long as the number of discharges is low, and the effect of light saturation due to increase in the number of discharges is limited. However, the effect of light saturation becomes more pronounced as the number of sustain discharges increases and light saturation begins to occur, and this effect increases as the sustain discharge frequency becomes higher.

In the first embodiment, a large number of sustain discharges are generated in a short time interval as a high-frequency drive while the number of sustain discharges is still low, but this is changed to a low-frequency drive when light saturation is manifested after several hundred repeated sustain discharges, and in this way, the occurrence of the light saturation phenomenon with increase in the number of sustain discharges is canceled by the suppression of the light saturation due to the reduction of the frequency of sustain discharges, thereby allowing a reduction of the effect of light saturation.

For example, if sustain discharge pulses are applied at a frequency of 100 kHz to each scan electrode and sustain electrode using a drive method of the prior art, a sustain discharge pulse applying time interval of 1.5 ms is necessary to generate 300 discharges. In contrast, if the initial 200 discharges are generated at a sustain discharge frequency of 200 kHz and the subsequent 100 discharges are generated at a sustain discharge frequency of 50 kHz using the drive method of the present invention, the total sustain discharge time interval is an equal 1.5 ms. In the initial 200 discharges, however, substantially the same luminance is obtained whether discharge is generated at 200 kHz or at 100 kHz because the effect of light saturation is limited, but when the light saturation phenomenon begins to manifest itself at the $200^{th}$ to $300^{th}$ discharge, higher luminance can be obtained by generation at a low frequency of 50 kHz, in which the effect of light saturation is limited, than when generating at 100 kHz.

(Second Embodiment)

Figure 9:
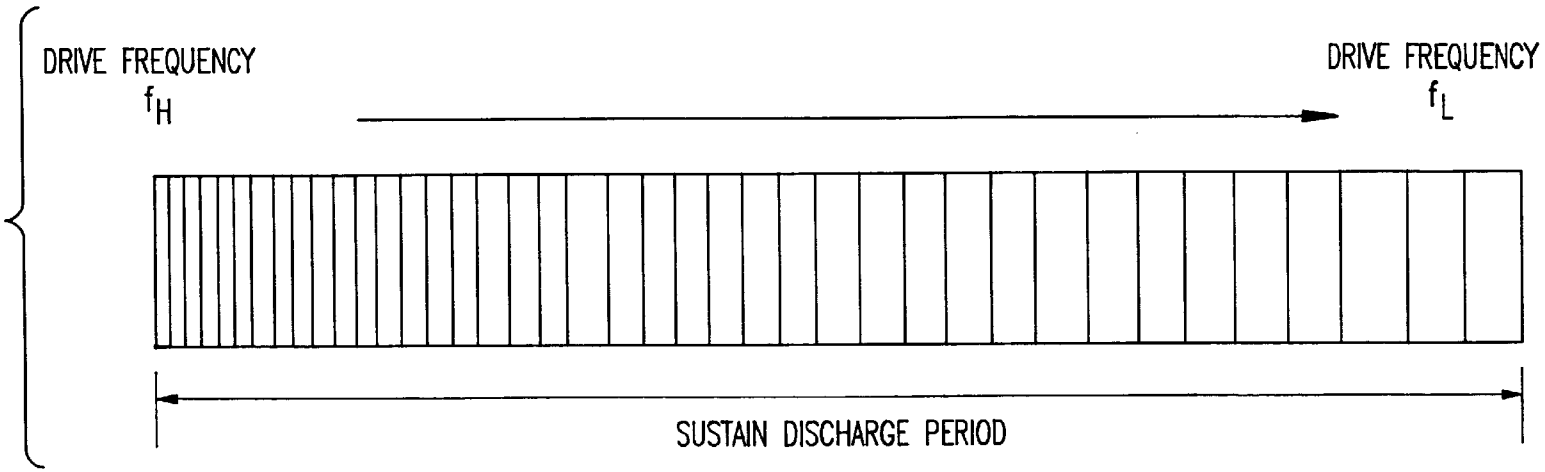
FIG. 9 shows the form of applied pulses during a sustain discharge period in the second embodiment of the present invention.

As shown in FIG. 9, in the second embodiment of the present invention, in Step 32, the drive frequency of applied pulses drops in stages from initial drive frequency $f_H$ to the final drive frequency $f_L$ during a sustain discharge period.

In the second embodiment, the decrease of frequency is divided into many stages and is therefore more effective in suppressing the light saturation than the first embodiment in which the frequency was decreased in two stages.

(Third Embodiment)

Figure 10:
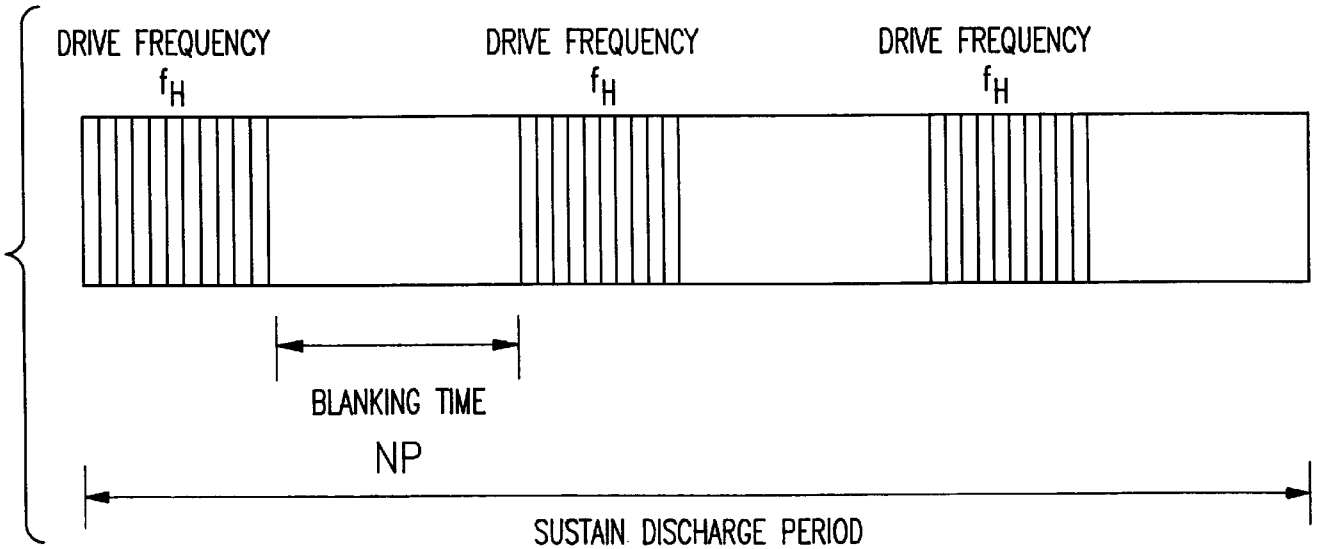
FIG. 10 shows the form of applied pulses during a sustain discharge period in the third embodiment of the present invention.

As shown in FIG. 10, in the third embodiment of the present invention, in Step 32, intervals during which sustain discharge pulses are applied at drive frequency $f_H$ and blank intervals NP in which sustain discharge pulses are not applied are alternately combined.

In the third embodiment, each of the intervals in which drive frequency $f_H$ is applied are set short enough that light saturation does not occur, for example, to a number of sustain discharges on the order of 100 discharges in which light saturation does not occur, and light saturation can therefore be suppressed as the sum of the sustain discharge period. In addition, this effect can be obtained to some degree even if, in place of blank period NP, an interval is used in which sustain discharge pulses are applied at a low drive frequency in which the effect of light saturation is sufficiently low.

(Fourth Embodiment)

Figure 11:
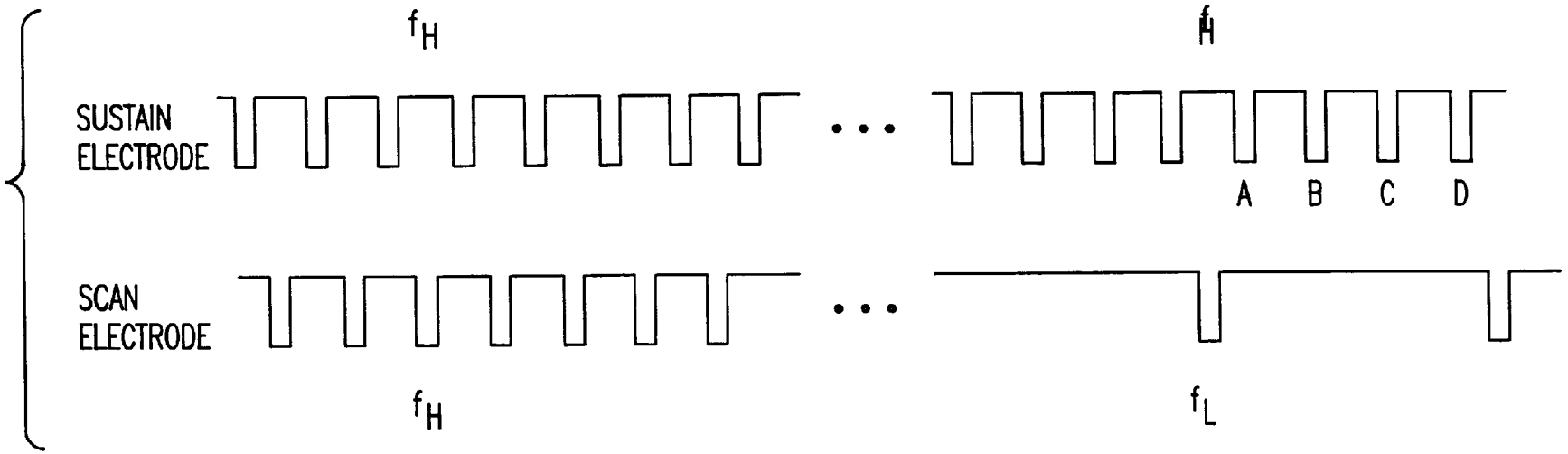
FIG. 11 shows the form of applied pulses during a sustain discharge period in the fourth embodiment of the present invention.

As shown in FIG. 11, in the fourth embodiment of the present invention, in Step 32, of the sustain discharge pulse sequences applied to sustain electrodes and scan electrodes during a sustain discharge period, the drive frequency of one sustain discharge pulse sequence, for example, the sustain discharge pulse sequence applied to the scan electrodes, is made a high frequency $f_H$ at the beginning of the sustain discharge period and a low frequency $f_L$ at the end of the sustain discharge period. On the other hand, the drive frequency of the sustain discharge pulse sequence applied to the sustain electrode is made a high frequency $f_H$ for the entire duration of the sustain discharge period. At the end of the sustain discharge period the drive frequency of the sustain discharge pulse of the scan electrodes is $f_L$ and the drive frequency of the sustain discharge pulse of the sustain electrodes is a different value $f_H$, the phase relation being therefore set such that the discharges arising from the sustain discharge pulses applied to each electrode do not coincide in time.

In the fourth embodiment, the drive frequency of the sustain discharge pulses applied to the scan electrodes is $f_L$ and the drive frequency of the sustain discharge pulses applied to the sustain electrodes is a value $f_H$ that is higher than $f_L$ at the end of a sustain discharge period, at which time the generated frequency of discharges becomes $2f_L$. This is because the potential difference between the positive wall charge stored in the scan electrodes and the negative wall charge stored in the sustain electrodes after the occurrence of discharge caused by sustain discharge pulses applied to the scan electrodes is combined with the negative sustain discharge pulse A applied to the sustain electrodes, thereby giving rise to reverse discharge. A negative wall charge is stored at the scan electrodes and a positive wall charge is stored at the sustain electrodes. Owing to the difference between the two drive frequencies, the next pulse to be applied to the PDP cell is the negative polarity pulse B to the sustain electrodes, but a potential difference is created in which the sustain electrodes are positive due to the wall charge already formed, and this combines with pulse B to produce a potential difference that is effectively small, whereby discharge does not occur. Discharges similarly do not occur with sustain discharge pulses C and D.

Sustain discharges thus do not occur with sustain discharge pulses B–D, and as a result, charged particles are not formed in the PDP cells and wall charge does not disappear. Consequently, when sustain discharge pulses of negative polarity are again applied to the scan electrodes, combination with the potential difference resulting from the wall charge generates sustain discharge. The generated frequency of discharge is thus governed by the lower frequency of the drive frequencies of the sustain discharge pulses that are applied to the sustain electrodes and scan electrodes during a sustain discharge period.

In the fourth embodiment, only one of the drive frequencies of sustain discharge pulses applied to electrodes needs to be varied, and such a construction is easier to realize than a case in which both drive frequencies of sustain discharge pulses applied to both electrodes are varied.

The variation of the drive frequency of sustain discharge pulses described in the first to fourth embodiments can be easily realized by counting the number of sustain discharge pulses applied at high frequency $f_H$ and then halting applying of pulses to form a blank for every prescribed counted number. In this case, the effect of the second embodiment can be achieved if the proportion of deleted sustain discharge pulses is gradually increased from the start to the end of a sustain discharge period. Alternatively, the effect of the third embodiment can be achieved if the proportion of deleted sustain discharge pulses is 100% in portions within a sustain discharge period.

The foregoing explanation has focused on varying the rive frequency of a sustain discharge period, but sufficient effect may also be obtained if this variation of drive frequency is applied to only the sub-fields having the greatest number of sustain discharges among the plurality of sub-fields that constitute one image display period. For example, this invention is particularly effective for a sub-field having high luminance with more than 100 sustain discharges because the effect of light saturation is strong in such a sub-field. In a sub-field having low luminance in which the number of sustain discharges is low, however, the effect of light saturation is limited and a fixed drive frequency as in the prior art may therefore be applied for the sustain discharge period of such a sub-field without significantly reducing the effect of the present invention.

While preferred embodiments of the present invention have been described using specific terms, such description is for illustrative purposes only, and it is to be understood that changes and variations may be made without departing from the spirit or scope of the following claims.

What is claimed is:

1. A method of driving a plasma display panel having a plurality of scan electrodes aligned in a row direction, a plurality of data electrodes aligned in a column direction, and a plurality of sustain electrodes formed parallel to said scan electrodes and each of said sustain electrodes formed as a pair with a respective scan electrode, comprising:

ON/OFF controlling display data by scan pulses applied to said scan electrodes and data pulses applied to said data electrodes in each of a plurality of sub-fields into which a unit image display period is divided; and effecting sustain discharge between said scan electrodes and sustain electrodes parallel to said scan electrodes in only those cells in which display data are ON following ON/OFF control of display data, wherein a sustain discharge period of at least one sub-field comprises a divided sustain discharge period comprising a plurality of sub-sustain discharge periods, and wherein in said divided sustain discharge period, sustain discharge pulses are applied to said sustain electrodes and said scan electrodes at a first frequency in a first sub-sustain discharge period and at a second frequency that is lower than said first frequency in a last sub-sustain discharge period.

2. A method of driving a plasma display panel having a plurality of scan electrodes aligned in a row direction, a plurality of data electrodes aligned in a column direction, and a plurality of sustain electrodes formed parallel to said scan electrodes and each of said sustain electrodes formed as a pair with a respective scan electrode, comprising:

ON/OFF controlling display data by scan pulses applied to said scan electrodes and data pulses applied to said data electrodes in each of a plurality of sub-fields into which a unit image display period is divided; and effecting sustain discharge between said scan electrodes and sustain electrodes parallel to said scan electrodes in only those cells in which the display data are ON following ON/OFF control of display data, wherein a sustain discharge period of at least one sub-field comprises a divided sustain discharge period comprising a plurality of sub-sustain discharge periods, and wherein in said divided sustain discharge period, sustain discharge pulses are applied to said sustain electrodes and said scan electrodes at a first frequency during a first sub-sustain discharge period and are thereafter applied only in alternating sub-sustain discharge periods.

3. A method of driving a plasma display panel having a plurality of scan electrodes aligned in a row direction, a plurality of data electrodes aligned in a column direction, and a plurality of sustain electrodes formed parallel to said scan electrodes and each of said sustain electrodes formed as a pair with a respective scan electrode, comprising:

ON/OFF controlling display data by scan pulses applied to said scan electrodes and data pulses applied to said data electrodes in each of a plurality of sub-fields into which a unit image display period is divided; and effecting sustain discharge between said scan electrodes and sustain electrodes parallel to said scan electrodes in only those cells in which the display data are ON following ON/OFF control of display data, wherein a sustain discharge period of at least one sub-field comprises a divided sustain discharge period comprising a plurality of sub-sustain discharge periods, and wherein in said divided sustain discharge period, sustain discharge pulses are applied to said scan electrodes at a first frequency and to said sustain electrodes at a second frequency in a first sub-sustain discharge period, and sustain discharge pulses are applied to one of said scan electrodes and said sustain electrodes in a second sub-sustain discharge period at a third frequency different from said first frequency and said second frequency.

4. A method of driving a plasma display panel according to claim 3, wherein said third frequency is lower than said first frequency and said second frequency.

5. A method of driving a plasma display panel according to claim 3, wherein said sustain discharge pulses applied at said third frequency are halted at intervals during said second sub-sustain discharge period.

6. A method of driving a plasma display panel according to claim 3, further comprising counting said discharge pulses applied at said third frequency; and halting application of discharge pulses at said third frequency after a predetermined number has been counted.

7. A method of driving a plasma display panel according to claim 3, further comprising:

counting a number of sustain discharges in each of said plurality of sub-fields; and applying said sustain discharges at said third frequency in a sustain discharge period having a most sustain discharges out of said plurality of sub-fields.

8. A method of driving a plasma display panel according to claim 1, further comprising varying said first frequency by halting applying of pulses at any interval within said last sub-sustain discharge period to produce said second frequency.

9. The method of driving a plasma display panel according to claim 8, wherein said varying of said first frequency includes counting a number of said discharge pulses and halting applying of selected ones of said pulses.

10. The method of driving a plasma display panel according to claim 8, wherein said varying of said first frequency includes effecting variation in a sub-field having a most sustain discharges of said plurality of sub-fields.

11. The method of driving a plasma display panel according to claim 1, wherein said plasma display becomes saturated during said first sub-sustain discharge period.

12. The method of driving a plasma display panel according to claim 1, wherein said first frequency and said second frequency are within a range of frequencies which begins with a highest frequency and incrementally decreases to a lowest frequency; and wherein said method further comprises applying, during a first sustain discharge period, sustain discharge pulses in said range of frequencies to both said sustain electrodes and said scan electrodes such that said sustain discharge pulses are applied beginning with said highest frequency incrementally decreasing to said lowest frequency.

13. The method of driving a plasma display panel according to claim 1, wherein during said first sub-sustain discharge period, said sustain discharge pulses are applied at said first frequency to both of said sustain electrodes and said scan electrodes and said first frequency is alternated with blank intervals during which said first frequency is not applied to one of said scan electrodes and said sustain electrodes.

14. The method of driving a plasma display panel according to claim 1, wherein a saturation of said plasma display panel occurs during said first sub-sustain discharge period and said second frequency suppresses said saturation of said plasma display panel.

15. The method of driving a plasma display panel according to claim 2, further comprising:

applying sustain discharge pulses at said first frequency to both of said sustain electrodes and said scan electrodes in a first sub-sustain discharge period;

applying sustain discharge pulses at said second frequency, lower than said first frequency, to both of said sustain electrodes and said scan electrodes in said alternate sub-sustain discharge periods; and varying said first frequency by halting applying of pulses at any interval within said last sub-sustain discharge period to produce said second frequency.

16. The method of driving a plasma display panel according to claim 15, wherein said varying of said first frequency includes counting the number of said discharge pulses and halting applying of selected ones of said pulses.

17. The method of driving a plasma display panel according to claim 15, wherein said varying of said first sustain discharge period includes effecting variation in a sub-field having a most sustain discharges of said plurality of sub-fields.

18. The method of driving a plasma display panel according to claim 2, wherein said plasma display panel becomes saturated during said first sub-sustain discharge period.

19. The method of driving a plasma display panel according to claim 2, wherein said first frequency and said second frequency are within a range of frequencies which begins with a highest frequency and incrementally decreases to a lowest frequency; and wherein said method further comprises applying, during said first sustain discharge period, sustain discharge pulses in said range of discharge frequencies to both said sustain electrodes and said scan electrodes such that said sustain discharge pulses are applied beginning with said highest frequency incrementally decreasing to said lowest frequency.

20. The method of driving a plasma display panel according to claim 2, wherein during said first sub-sustain discharge period, said sustain discharge pulses are applied at said first frequency to both of said sustain electrodes and said scan electrodes and said first frequency is alternated with blank intervals during which said first frequency is not applied to one of said scan electrodes and said sustain electrodes in said alternate sub-sustain discharge periods.

* * * * *